United States Patent [19]

Wiener et al.

[11] Patent Number: 4,542,668

[45] Date of Patent: Sep. 24, 1985

[54] PLIERS-TYPE PRESSING TOOL

[75] Inventors: Hans Wiener, Täby; Hans Undin, Akersberga, both of Sweden

[73] Assignee: C. A. Weidmüller GmbH & Co., Fed. Rep. of Germany

[21] Appl. No.: 529,968

[22] Filed: Sep. 7, 1983

[30] Foreign Application Priority Data

Sep. 9, 1982 [SE] Sweden ..... 8205127

[51] Int. Cl.[4] ..... B25B 7/12

[52] U.S. Cl. ..... 81/355; 81/361; 81/126

[58] Field of Search ..... 81/346–347, 81/352–355, 361–363, 367, 373, 375–377, 129, 126, 128; 30/182, 183, 242; 72/409, 410

[56] References Cited

U.S. PATENT DOCUMENTS

| | | | |
|---|---|---|---|
| 125,221 | 4/1872 | Roache | 81/361 X |
| 432,056 | 7/1890 | Leavitt | 30/242 |
| 648,324 | 4/1900 | Wolfe | 81/361 X |
| 946,506 | 1/1910 | Gillespie et al. | 81/126 |
| 1,326,820 | 12/1919 | Youdelman | 81/361 X |
| 1,442,351 | 1/1923 | Martin | 81/126 |
| 2,820,292 | 1/1958 | Bouten et al. | 30/182 |

FOREIGN PATENT DOCUMENTS

| | | | |
|---|---|---|---|
| 745945 | 3/1956 | United Kingdom | 81/361 |

*Primary Examiner*—Frederick R. Schmidt
*Assistant Examiner*—Debra S. Meislin
*Attorney, Agent, or Firm*—Toren, McGeady, Stanger, Goldberg & Kiel

[57] ABSTRACT

A hand-operated tool of the pliers type includes a body member in which a rectilinear guiding track for a jaw carrier is provided. One stationary jaw for treating a working piece is arranged at one end of the guiding track and another jaw on the jaw carrier. A handle is pivoted to the body member laterally of the guiding track and is provided with faces for engagement with co-operating faces on the jaw carrier so as to press the jaw carrier and the jaw mounted on it towards the stationary jaw when the handle is activated.

13 Claims, 5 Drawing Figures

PLIERS-TYPE PRESSING TOOL

SUMMARY OF THE INVENTION

The present invention is directed to a hand-operated tool of the pliers-type having a body member to which a first handle is firmly attached and a second handle is pivoted. Two co-operating members, affectable by said handles, and affecting in their turn a work piece interposed between them, are disposed between the point of pivotal attachment of the second handle and the rear free ends of the handles. Tools of this kind have already been known and a cutting tool in which one member is moved relative to the other member along a circular path is described in the U.S. Pat. No. 2,752,676 issued on July 3, 1956 to R. W. Trickle.

The primary object of the present invention is to improve tools or appliances of this kind, particularly so as to obtain in a simple manner exact guiding along a rectilinear path of one of the jaw members during the scissors-like approaching movement of the handles. Another object of the invention is to obtain effective transmission of force from the pivoted handle to the rectilinearly guided jaw member in the final phase of this member's approaching movement to the other jaw member. Still another object of the invention is to provide a readily mountable jaw carrier for the movable jaw member.

A significant feature of the present invention is the provision, in a tool body to which one handle is rigidly attached and a second handle is pivoted, of a rectilinear guiding path or track extending transversely to the direction of the fixed handle for a jaw said second handle is spaced from the guiding track at right angles to the direction of the guiding track, and the second handle extends from this pivot pin towards and beyond the guiding track one jaw member is stationarily arranged at one end of said track and the other one on said carrier. Co-operating engagement means are provided on the second handle and on the carrier so that when the handle is pivoted towards the body, the jaw carrier with one jaw member is pushed towards the stationary other jaw member.

The various features of novelty which characterize the invention are pointed out with particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

BRIEF DESCRIPTION OF THE DRAWING

In the drawing, where like characters designate corresponding parts throughout.

DETAIL DESCRIPTION OF THE INVENTION

Figure 1:
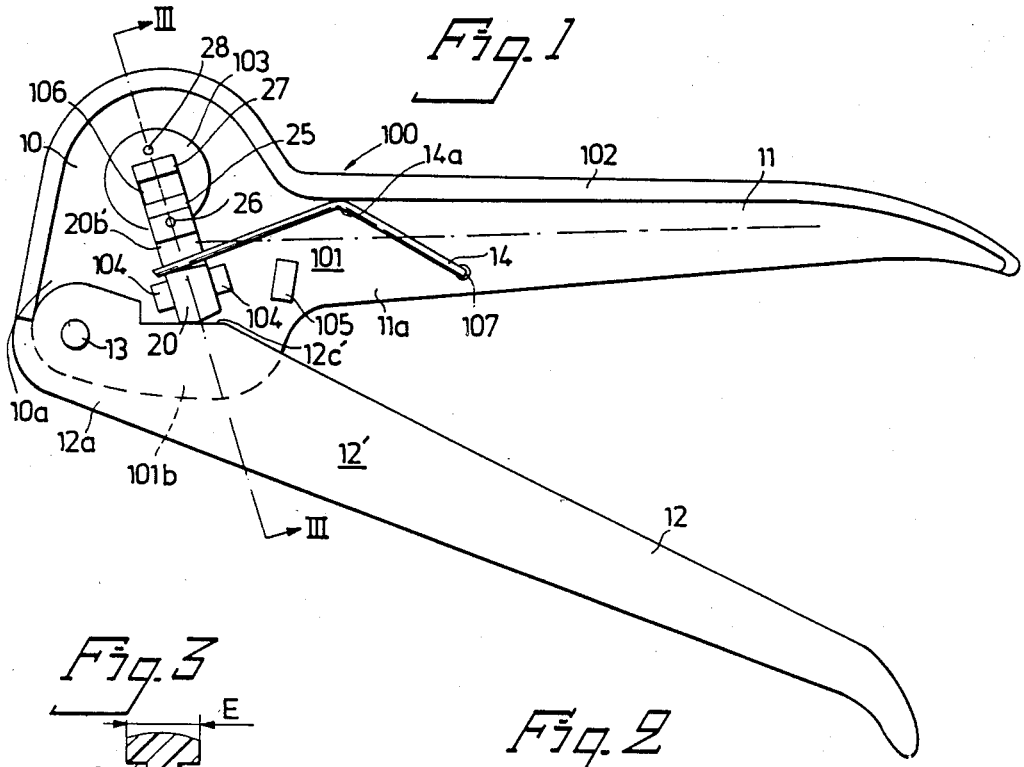
FIG. 1 is an elevational view of one embodiment of the tool incorporating the present invention and shown in the open position.
Figure 3:
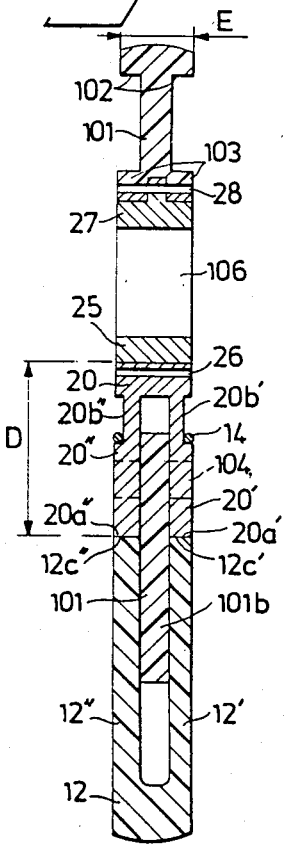
FIG. 3 is a cross-sectional view, on an enlarged scale, along the plane III—III in FIG. 1.
Figure 2:
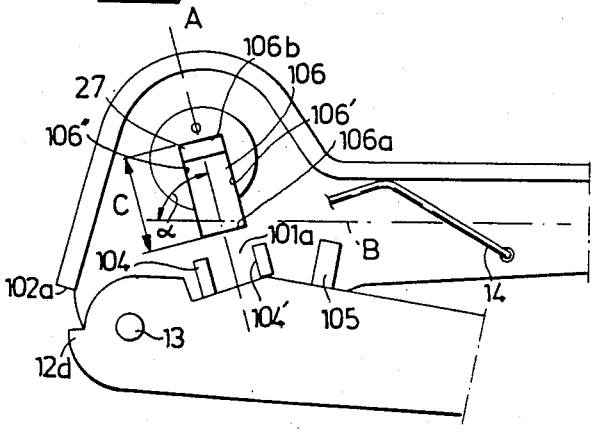
FIG. 2 is an elevational view of the front part of the tool of FIG. 1 in the closed position and with the jaw carrier removed.

In FIGS. 1 to 3, a tool is illustrated which may be made of any arbitrary convenient material such as metal or plastics, possibly plastics reinforced with glass fibres. The tool has a body member 10 with a first end 10*a*. A first handle 11 with a first end 11*a* and a second end 11*b* has its first end 11*a* firmly attached to body member 10 at a position spaced from its first end 10*a* so as to define therewith a rigid subassembly unit 100. A second handle 12 has a first end 12*a* adjacent the first end 10*a* of the body member 10 and a second end 12*b*. The second handle 12 is pivoted at its first end 12*a* to the first end 10*a* of body member 10 by means of a pivot pin 13, defining the pivot point of handle 12.

In the example illustrated, sub-assembly unit 100 consists essentially of a planar plate 101 from which project at least in one direction, i.e. towards the observer of FIG. 1, a peripheral edge 102, a boss portion 103, a pair of guiding blocks 104 defining projecting guiding means, and possibly an end stop block 105. Preferably, however, said elements project at both sides from plate 101, as is best seen in FIG. 3. The second handle 12 is conveniently U-shaped in cross-section, or, more generally, has with two side parts 12', 12'' which are spaced apart by a central free space and which at least in the region of the first end 12*a* straddle carrier plate 101.

In the plate 101 and in the boss portion 103 there is provided a rectilinear guiding track for a jaw carrier 20 which is slidably mounted therein. The guiding track is defined by parallel edges or inner faces 106', 106'' (FIG. 2) of a window 106 provided in the carrier plate 101 and in the boss portion 103, as well as by the inner faces such as 104' of the guiding blocks 104. The window 106 is terminated, at the first end thereof adjacent said boss portion 103 by a transverse edge 106*b*, and at the second end adjacent said blocks 104, by a transversal edge 106*a*. Said pivot pin 13 of the handle 12 is laterally spaced from the guiding track 106 in a direction at right angles to the axial direction A of the guiding track, note FIG. 2, and close to the first end 10*a* of the body member 10, i.e., on the opposite side thereof than where the fixed handle 11 is attached. The pivoted handle 12 extends thus from pivot point 13 towards and beyond the guiding track 106.

At its upper end as viewed in FIG. 1, jaw carrier 20 may form a working member, i.e. a jaw, for affecting a working piece (not shown), or it may be adapted to carry an interchangeable working member such as a pressing jaw 25, affixed with the aid of a retainer pin 26. The upper or second transversal edge 106*b* terminating window 106 may either embody a co-operating stationary working member or jaw or it may be provided with an interchangeable working member such as jaw 27, affixed by retainer pin 28. The jaw carrier 20 normally rests in track 106 at the end thereof closer to the second handle 12 and is movable in track 106 towards the opposite end of the track where the stationary jaw member 27 is located.

The jaw carrier 20 has in the example illustrated, note FIG. 3 the shape of an inverted U with a central part carrying said pressing jaw 25 and with two legs 20' and 20'' extend beyond the transverse edge 106*a* of window 106 and there, i.e. essentially in the area 101*a* between the guiding blocks 104, straddling the plate 101 in a similar to that of the handle 12.

For the transmission of force and motion from the second handle 12 to the jaw carrier 20 upon activation of the second handle, there are provided transmission means on the handle 12 and the jaw carrier 20 respectively, defined by engagement faces 12*c*', 12*c*'' and 20*a*', 20*a*''.

Figure 4:
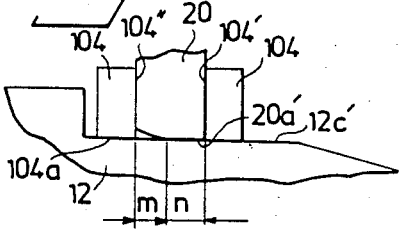
FIG. 4 shows on an enlarged scale, a detail of the tool of FIGS. 1 to 3 in closed position.

The engagement faces 12*c*', 12*c*'', located on the two side parts 12', 12'' of the second handle 12, are rectilinear or, more precisely, planar in the embodiment illustrated. The engagement faces 20*a*', 20*a*'' situated on the free ends of the two legs 20', 20'' of jaw carrier 20 have in the embodiment of FIGS. 1 to 3 a first portion m, located closer to the forward end 10*a* of the body member 10, which is convexly curved, and an annexed second portion n which is planar, as is best seen in FIG. 4. It will be realised that when motion is transmitted to the jaw carrier in the sense of the axial direction A of the guiding track, there always will also take place a slight gliding movement between the two transmitting means in contact in radial direction relative to the pivot pin 13.

The jaw carrier 20 has two outer side faces in which there are provided recesses 20*b*', 20*b*'' for receiving the ends of a stirrup-shaped spring 14 having buckled legs. The central or web part of spring 14 passes through an opening 107 in carrier plate 101 and the buckled portions 14*a* of the legs on both sides of carrier plate 101 bear against the projecting edge 102 so that spring 14 constantly affects the jaw carrier 20 and presses at on the second handle 12.

The movement of handle 12 is limited by two stop means. The first stop means defines the open position of the handles and of the tool and is embodied by a terminal face or lip 102*a* (FIG. 2) of the projecting edge 102 against which a projection 12*d* of the second handle 12 abuts. Both said means define edges on the periphery of the respective part. The second stop means defines the closed postion of the handles A and of the tool and the inner end position of the jaw carrier 20 and is defined by the stop blocks 105 (one on each side of carrier plate 101). It will be, however, readily recognised from the drawing that the function of the second stop means also may be performed by the lower terminal faces 104*a* (FIG. 4) of the guiding blocks 104.

The direction of the guiding track, as defined by the angle $\alpha$ subtended by the axial direction A of the track and the direction B of the stationary first handle 11, is in the example illustrated in the order 70° and may in general be between 30° and 120°. The engagement faces 12*c*', 12*c*'' and 20*a*' and 20*a*'' respectively, are arranged essentially radially relative to the pivot pin 13, and the guiding track 106 extends in the close position of the tool principally at right angles to all these faces.

It will be realised that this radial disposition of at least a part of one engagement face is caused by the above mentioned slight gliding movement of one transmitting means relative to the other.

The tool operates as follows:

After a work piece has been inserted between the jaw members 25, 27, the second handle 12 is approached to the first handle 11. In the course of this approach, the curved portions m of the engagement faces 20*a*' and 20*a*'' performs a rolling motion relative the engagement faces 12*c*', 12*c*'' with which they have only paint-like contact. In the final phase of the approaching motion of the handles 11, 12 and of the jaws members 25, 27 moves the contact zone between the faces 12*c*', 12*c*'' and 20*a*', 20*a*'' moves however onto the planar portion n where face-like contact is provided for better transfer of force. This stage is illustrated in FIG. 4. The transfer of force in the final phase is also promoted by the fact that, as already mentioned the faces 12*c*', 12*c*'' extend then at right engagement angles relative to the guiding track.

Figure 5:
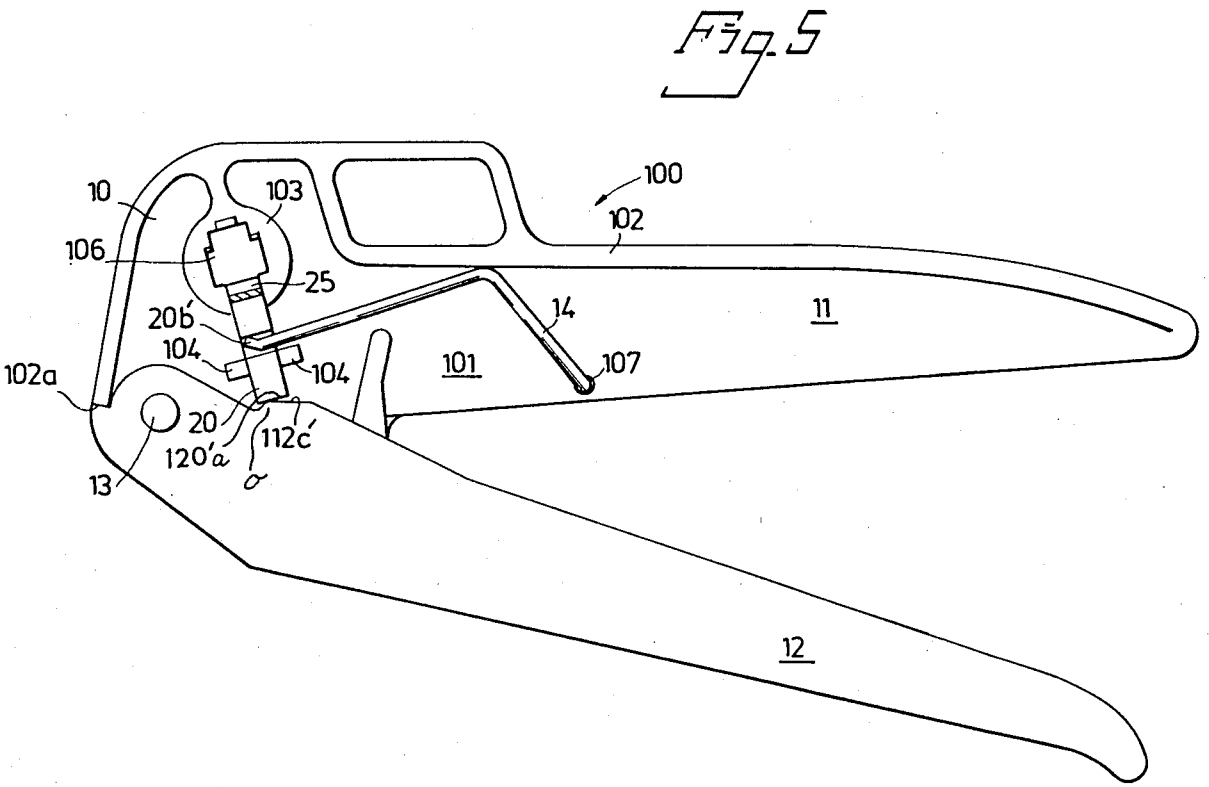
FIG. 5 is an elevational view, similar to FIG. 1, illustrating a second embodiment of the tool incorporating the present invention.

In FIG. 5 a modified embodiment of the tool of the present invention is shown. Point-like engagement of the engagement faces 112*c*', with the contact faces 120*a*',120*a*'' in the initial phase of a working operation is here achieved by said face 112*c*' having a corner or junction line o approximately at the location where the parts m and n of the faces 20*a*', 20*a*' meet, not FIG. 4, and said face 120*a*' is entirely planar.

Although the invention is not limited to the embodiments illustrated in the drawing which have a central carrier plate and a U-shaped jaw carrier, these embodiments have the advantage that the jaw carrier can be readily inserted into the guiding track so that it is exactly guided in its movement in the track. To this purpose, the length C (FIG. 2) of window 106 is conveniently selected so as to be essentially equal to the length D of the jaw carrier (preferably when the jaw member 25, is removed), so that the carrier 20 may be readily inserted the side into the window 106 from the side. Window 106 may, however also be shorter than that and the jaw carrier 20 made of two parts, e.g. one comprising one leg and the central part, and the other being a separate second leg, both parts being screwed together after insertion into the window.

Carrier 20 is upon movement in the guiding track guided in its undivided upper or central portion by the side edges 106', 106'' of the window 106, and in its lower portion, defined by the two legs 20', 20'' by the said guide blocks 104 and also by an adjacent portion of the body member,viz. the region 101*a* of the carrier plate 101 which is straddled by said legs, as illustrated in FIG. 3. When the jaw member 27, and still more when even the jaw member 25, is put in place and secured by pin 26 or 28, the free length of window 106 is reduced so that the jaw carrier 20 is secured against falling out, because the lowest portions of the legs 20', 20'' no longer can pass the lower transversal edge 106*a* of the window 106.

Also the second handle 12 is guided in a similar way as the carrier 20, viz. by its side parts 12', 12'' gliding along the region 101*b* (FIG. 1) of the plate 101.

The projecting edge 102 and the boss portion 103 have conveniently identical thickness E and this thickness is preferably equal to the overall thickness of the second handle 12.

While specific embodiments of the invention have been shown and described in detail to illustrate the application of the inventive principles, it will be understood that the invention may be embodied otherwise without departing from such principles. So may e.g. the engagement faces on the jaw carrier or on the second handle be replaced by projecting pins engaging the contact faces on the other member.

We claim:

1. A pressing tool of the pliers-type comprising, in combination, a body member having a first end and a second end with the first end and second ends disposed in spaced relation on a longitudinal axis of said body member; a first elongated handle rigidly connected to said second end of said body member and extending outwardly therefrom generally as an extension of said longitudinal axis said first handle having a first end connected to the second end of said body member and a second end spaced from the first end thereof; a rectilinear guiding track on said body member having a first end and a second end disposed in spaced relation on an axis of said guiding track and the axis of said guiding track is disposed transversely of the longitudinal axis of said body member; a stationary first jaw member situated at said first end of said track; a jaw carrier reciprocally mounted in said track for movement toward and away from said first jaw member; a second jaw member mounted on said jaw carrier for movement therewith; a second elongated handle; a pivot pin located on said body member between the first end of said body member and the axis of said guiding track; said second handle being pivotally mounted on said pivot pin and having a first end located adjacent the first end of said body member and a second end spaced from the first end thereof, said second handle being pivotally displaceable between an open position and a closed position with the second ends of said first handle and second handle being spaced further apart in the open position than in the closed position; and cooperating means on said second handle and said jaw carrier for the transmission of movement and force from said second handle to said jaw carrier when said second handle is pivoted from the open position to the closed position, said cooperating means situated adjacent to said axis of said guiding track and on second handle, said cooperating means being located between said pivot pin and said second end of said body member, at least one of said cooperating means on said second handle and said jaw carrier being defined at least in part by a planar engagement face extending in the closed position of the handles approximately radially relative to said pivot pin; said jaw carrier is U-shaped in cross-section and has a central part carrying said second jaw member and a pair of spaced legs projecting from said central part and defining an open space therebetween with the ends of said legs spaced outwardly from said central part being free ends and said legs being at their free ends provided with said cooperating means disposed in contact with said corresponding means on said second handle.

2. A pressing tool, as set forth in claim 1, wherein said cooperating means on the jaw carrier comprises an engagement face having a convexly curved surface and a planar surface extending approximately radially relative to said pivot pin.

3. A pressing tool, as set forth in claim 1, comprising spring means mounted on said first handle and disposed in contact with at least one of said legs for biasing said jaw carrier toward said second handle.

4. A pressing tool, as set forth in claim 1, wherein stop means are located on said body member for defining one of the closed position or the open position of said second handle.

5. A pressing tool, as set forth in claim 1, wherein in the closed position of said second handle the axis of said guiding track extends substantially at right angles to said planar engagement face.

6. A pressing tool of the pliers-type comprising, in combination, a body member having a first end and a second end with the first and second ends disposed in spaced relation on a longitudinal axis of said body member; a first elongated handle rigidly connected to said second end of said body member and extending outwardly therefrom generally as an extension of said longitudinal axis; said first handle having a first end connected to the second end of said body member and a second end spaced from the first end thereof; a rectilinear guiding track on said body member having a first end and a second end disposed in spaced relation on an axis of said guiding track and the axis of said guiding track is disposed transversely of the longitudinal axis of said body member; a stationary first jaw member situated at said first end of said track; a jaw carrier reciprocally mounted in said track for movement toward and away from said first jaw member; a second jaw member mounted on said jaw carrier for movement therewith; a second elongated handle; a pivot pin located on said body member between the first end of said body member and the axis of said guiding track; said second handle being pivotally mounted on said pivot pin and having a first end located adjacent the first end of said body member and a second end spaced from the first end thereof, said second handle being pivotally displaceable between an open position and a closed position with the second ends of said first handle and second handle being spaced further apart in the open position than in the closed position; and cooperating means on said second handle and said jaw carrier for the transmission of movement and force from said second handle to said jaw carrier when said second handle is pivoted from the open position to the closed position, said cooperating means situated adjacent to said axis of said and on said guiding track second handle, said cooperating means being located between said pivot pin and said second end of said body member, at least one of said cooperating means on said second handle and said jaw carrier being defined at least in part by a planar engagement face extending in the closed position of the handles approximately radially relative to said pivot pin, said body member and said first handle rigidly connected thereto are formed by a single planar plate, and said jaw carrier is U-shaped in cross-section having a central part carrying said second jaw member and two legs projecting from said central part and defining an open spaced therebetween and a portion of said cooperating means being located at the free ends of the legs and said legs straddling a portion of said plate adjacent the second end of said guiding track.

7. A pressing tool, as set forth in claim 6, wherein said plate has a peripheral edge thereon projecting outwardly from said planar plate on at least one side of said plate.

8. A pressing tool, as set forth in claim 6, wherein a boss portion projects outwardly from at least one side of said planar plate and said boss portion surrounds said first end of said guiding track.

9. A pressing tool, as set forth in claim 6, wherein said second handle is U-shaped in cross-section having two laterally spaced side parts straddling said plate.

10. A pressing tool, as set forth in claim 6, wherein guiding blocks project outwardly from said body member and form additional guiding surfaces for said jaw carrier with said guiding blocks disposed in lateral engagement with at least one of said legs of said jaw carrier.

11. A pressing tool, as set forth in claim 10, wherein said guiding blocks also define stop means for the closed position of said second handle.

12. A pressing tool, as set forth in claim 10, wherein said stop means for the open position of said second handle comprises a pair of cooperating edges located on the periphery of said body member and of said handle.

13. A pressing tool, as set forth in claim 10, wherein said second end of said guiding track is spaced from said guiding blocks and said portion of said planar plate is the portion situation between said guiding blocks.

* * * * *